US011460024B2

(12) United States Patent
Ludwig et al.

(10) Patent No.: US 11,460,024 B2
(45) Date of Patent: Oct. 4, 2022

(54) METHOD OF MONITORING A VOLUME INDEX VALVE OF A COMPRESSOR AND DIAGNOSTIC SYSTEM

(71) Applicant: Carrier Corporation, Palm Beach Gardens, FL (US)

(72) Inventors: Tyler Joseph Ludwig, Liverpool, NY (US); Biswajit Mitra, Huntersville, NC (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 913 days.

(21) Appl. No.: 16/322,768

(22) PCT Filed: Aug. 1, 2017

(86) PCT No.: PCT/US2017/044859

§ 371 (c)(1),
(2) Date: Feb. 1, 2019

(87) PCT Pub. No.: WO2018/026791

PCT Pub. Date: Feb. 8, 2018

(65) Prior Publication Data

US 2021/0381505 A1 Dec. 9, 2021

Related U.S. Application Data

(60) Provisional application No. 62/369,816, filed on Aug. 2, 2016.

(51) Int. Cl.

| | |
|---|---|
| ***G08B 21/00*** | (2006.01) |
| ***F04C 2/12*** | (2006.01) |
| ***G08B 21/18*** | (2006.01) |

(52) U.S. Cl.

CPC ..... *F04C 2/12* (2013.01); *G08B 21/182* (2013.01); *F04C 2270/07* (2013.01); *F04C 2270/78* (2013.01)

(58) Field of Classification Search

CPC .... F04C 2/12; F04C 2270/07; F04C 2270/78; G08B 21/182

(Continued)

(56) References Cited

U.S. PATENT DOCUMENTS 3,811,021 A * 5/1974 Ito ..... H01H 35/38 200/82 D
4,080,110 A 3/1978 Szymaszek (Continued)

FOREIGN PATENT DOCUMENTS

EP 0663552 A1 7/1995
EP 1184570 A2 3/2002

(Continued)

OTHER PUBLICATIONS

Chinese First Office Action for application CN 20170050187.8, dated Jan. 15, 2020, 7 pages.

(Continued)

*Primary Examiner* — Zhen Y Wu
(74) *Attorney, Agent, or Firm* — Cantor Colburn LLP

(57) ABSTRACT

A method of monitoring a volume index valve of a compressor is provided. The method includes recording a first reading of an operating condition of the compressor when the volume index valve is in a first position. The method also includes switching the volume index valve to a second position. The method further includes recording a second reading of the operating condition of the compressor when the volume index valve is in the second position. The method yet further includes calculating a difference between the first reading and the second reading. The method also includes comparing the difference to a predetermined threshold difference to determine if the volume index valve is moving between the first position and the second position in a desired manner.

15 Claims, 3 Drawing Sheets

(58) Field of Classification Search
USPC ..... 340/679
See application file for complete search history.

(56) References Cited

U.S. PATENT DOCUMENTS

| | | | | |
|---|---|---|---|---|
| 5,027,608 | A | 7/1991 | Rentmeester et al. | |
| 5,362,206 | A * | 11/1994 | Westerman | F04B 47/02 417/18 |
| 5,524,484 | A | 6/1996 | Sullivan | |
| 5,784,245 | A | 7/1998 | Moraghan et al. | |
| 6,307,376 | B1 | 10/2001 | Alexander et al. | |
| 6,621,269 | B2 | 9/2003 | Ward et al. | |
| 7,357,019 | B2 | 4/2008 | McDonald et al. | |
| 7,441,451 | B2 | 10/2008 | McDonald et al. | |
| 7,446,541 | B2 | 11/2008 | Xiao et al. | |
| 7,540,572 | B2 | 6/2009 | Nakamura | |
| 7,877,194 | B2 | 1/2011 | Suyama | |
| 7,908,913 | B2 | 3/2011 | Cinpinski et al. | |
| 8,453,674 | B2 | 6/2013 | Cordle et al. | |
| 9,032,750 | B2 * | 5/2015 | Nemit, Jr | F25B 49/022 62/228.1 |
| 9,097,456 | B2 | 8/2015 | Thogersen et al. | |
| 10,533,556 | B2 * | 1/2020 | Johnson | F04C 29/124 |
| 2002/0107665 | A1 * | 8/2002 | Tyson | A47L 15/0049 702/183 |
| 2003/0007873 | A1 * | 1/2003 | Hattori | F04C 28/125 417/279 |
| 2004/0109782 | A1 * | 6/2004 | Tang | F04C 18/16 418/201.2 |
| 2005/0145009 | A1 * | 7/2005 | Vanderveen | A61M 5/16854 73/1.57 |
| 2012/0027632 | A1 * | 2/2012 | Nemit, Jr | F04C 28/125 417/440 |
| 2013/0216414 | A1 * | 8/2013 | Kopko | F04C 2/18 418/201.2 |
| 2015/0093273 | A1 * | 4/2015 | Johnson | F04C 28/24 418/1 |
| 2016/0084251 | A1 * | 3/2016 | Zhu | F04C 28/125 418/21 |
| 2016/0319815 | A1 * | 11/2016 | Akei | F04C 28/16 |
| 2018/0017060 | A1 * | 1/2018 | Nemit, Jr. | F04C 18/16 |
| 2021/0381505 | A1 * | 12/2021 | Ludwig | F04C 18/16 |

FOREIGN PATENT DOCUMENTS

| | | | |
|---|---|---|---|
| GB | 2534066 | A | 7/2016 |
| JP | H1182341 | A | 3/1999 |
| JP | 2004132343 | A * | 4/2004 |
| JP | 2004132343 | A | 4/2004 |
| JP | 4123893 | B2 | 7/2008 |

OTHER PUBLICATIONS

International Search Report and Written Opinion regarding International Application No. PCT/US2017/044859; dated Oct. 20, 2017; 15 pages.

Steve Garrett, Shortcuts to GM Solenoid Electrical Diagnosis, Part 2, Gears, Jul. 2007, pp. 20-27.

Indian Search Report for Application No. 201917006123; dated Dec. 15, 2020; 5 Pages.

* cited by examiner

METHOD OF MONITORING A VOLUME INDEX VALVE OF A COMPRESSOR AND DIAGNOSTIC SYSTEM

CROSS-REFERENCE TO RELATED APPLICATIONS

This application is based on International Application No. PCT/US2017/044859, filed on Aug. 1, 2017, which claims priority to U.S. Provisional Patent Application Ser. No. 62/369,816, filed on Aug. 2, 2016, both of which are incorporated herein by reference in their entireties.

BACKGROUND OF THE DISCLOSURE

The embodiments described herein generally relate to volume index valves for compressors and, more particularly, to a method of monitoring such a valve, as well as to a volume index valve diagnostic system.

Screw compressors are commonly used in air conditioning and refrigeration applications. In such compressors, intermeshed male and female lobed rotors or screws are rotated about their axes to pump a working fluid, such as refrigerant, from a low pressure inlet end to a high pressure outlet end. A screw compressor having fixed inlet and discharge ports built into the housing are optimized for a specific set of suction and discharge conditions and pressures. However, the system in which the compressor is connected rarely operates under constant conditions, especially in an air conditioning application. Nighttime, daytime, and seasonal temperatures can affect the volume ratio of the system and the efficiency with which the compressor operates. Volume ratio or volume index (VI) is the ratio of the volume of vapor inside the compressor as the suction port closes to the volume of vapor inside the compressor as the discharge port opens. Screw compressors, scroll compressors, and other similar machines generally have a fixed volume index based on the geometry of the compressor.

In a system where the load varies, the amount of heat being rejected in the condenser fluctuates causing the high side pressure to rise or fall, and resulting in a volume index different from the compressor's fixed volume index. To improve efficiency, the pressure inside the compressor should be generally equal to the pressure in the discharge line from the compressor. If the inside pressure exceeds the discharge pressure, over-compression of the gas occurs, and if the inside pressure is too low, back flow occurs, both resulting in a system efficiency loss. Therefore, the volume index of the compressor should vary to maximize the efficiency of the compressor at non-uniform operating conditions.

A volume index valve may be employed to selectively open and close at various points in the compression process to obtain better control of the volume index at different operating conditions, such as part load operation. However, the volume index valve does not offer feedback to determine if operational failure has occurred. Therefore, real-time operational monitoring of the volume index valve is unavailable. If a volume index valve is not operating properly with no monitoring, the overall system might undesirably operate at a lower efficiency than otherwise available.

BRIEF DESCRIPTION OF THE DISCLOSURE

According to one embodiment, a method of monitoring a volume index valve of a compressor is provided. The method includes recording a first reading of an operating condition of the compressor when the volume index valve is in a first position. The method also includes switching the volume index valve to a second position. The method further includes recording a second reading of the operating condition of the compressor when the volume index valve is in the second position. The method yet further includes calculating a difference between the first reading and the second reading. The method also includes comparing the difference to a predetermined threshold difference to determine if the volume index valve is moving between the first position and the second position in a desired manner.

In addition to one or more of the features described above, or as an alternative, further embodiments may include recording a first plurality of readings of the operating condition when the volume index valve is in the first position. Also included is averaging the first plurality of readings. Further included is recording a second plurality of readings of the operating condition when the volume index valve is in the second position. Yet further included is averaging the second plurality of readings, wherein the difference calculated is a difference between the averaged first and second plurality of readings.

In addition to one or more of the features described above, or as an alternative, further embodiments may include initiating an alert if the difference does not exceed the predetermined threshold.

In addition to one or more of the features described above, or as an alternative, further embodiments may include maintaining the alert until the alert is manually reset.

In addition to one or more of the features described above, or as an alternative, further embodiments may include that the compressor continues to operate when the alert is initiated.

In addition to one or more of the features described above, or as an alternative, further embodiments may include that the operating condition is a variable frequency drive power of the compressor.

In addition to one or more of the features described above, or as an alternative, further embodiments may include that the operating condition is a measured current of the compressor.

In addition to one or more of the features described above, or as an alternative, further embodiments may include automatically performing the method at a specified time interval.

In addition to one or more of the features described above, or as an alternative, further embodiments may include that the first position of the volume index valve is an open position and the second position of the volume index valve is a closed position.

In addition to one or more of the features described above, or as an alternative, further embodiments may include that the first position of the volume index valve is a closed position and the second position of the volume index valve is an open position.

In addition to one or more of the features described above, or as an alternative, further embodiments may include that the method is performed under stable operating conditions of a system that the compressor operates within.

According to another embodiment, a volume index valve diagnostic system includes a compressor. Also included is a volume index valve disposed in the compressor, the volume index valve moveable between an open position and a closed position. Further included is a controller in operative communication with the volume index valve to control whether the volume index valve is in the open position or the closed position. Yet further included is a processing device for receiving data for an operating condition of the compressor when the volume index valve is in the open position and when the volume index valve is in the closed position, the processing device having stored in memory a predetermined threshold of a difference between the operating condition at the open position and the closed position.

In addition to one or more of the features described above, or as an alternative, further embodiments may include that the operating condition is a variable frequency drive power of the compressor.

In addition to one or more of the features described above, or as an alternative, further embodiments may include that the operating condition is a measured current of the compressor.

In addition to one or more of the features described above, or as an alternative, further embodiments may include that the processing device initiates an alert if the difference is less than the predetermined threshold.

These and other advantages and features will become more apparent from the following description taken in conjunction with the drawings.

BRIEF DESCRIPTION OF THE DRAWINGS

The subject matter which is regarded as the disclosure is particularly pointed out and distinctly claimed in the claims at the conclusion of the specification. The foregoing and other features and advantages of the disclosure are apparent from the following detailed description taken in conjunction with the accompanying drawings in which:

DETAILED DESCRIPTION OF THE DISCLOSURE

Figure 1:
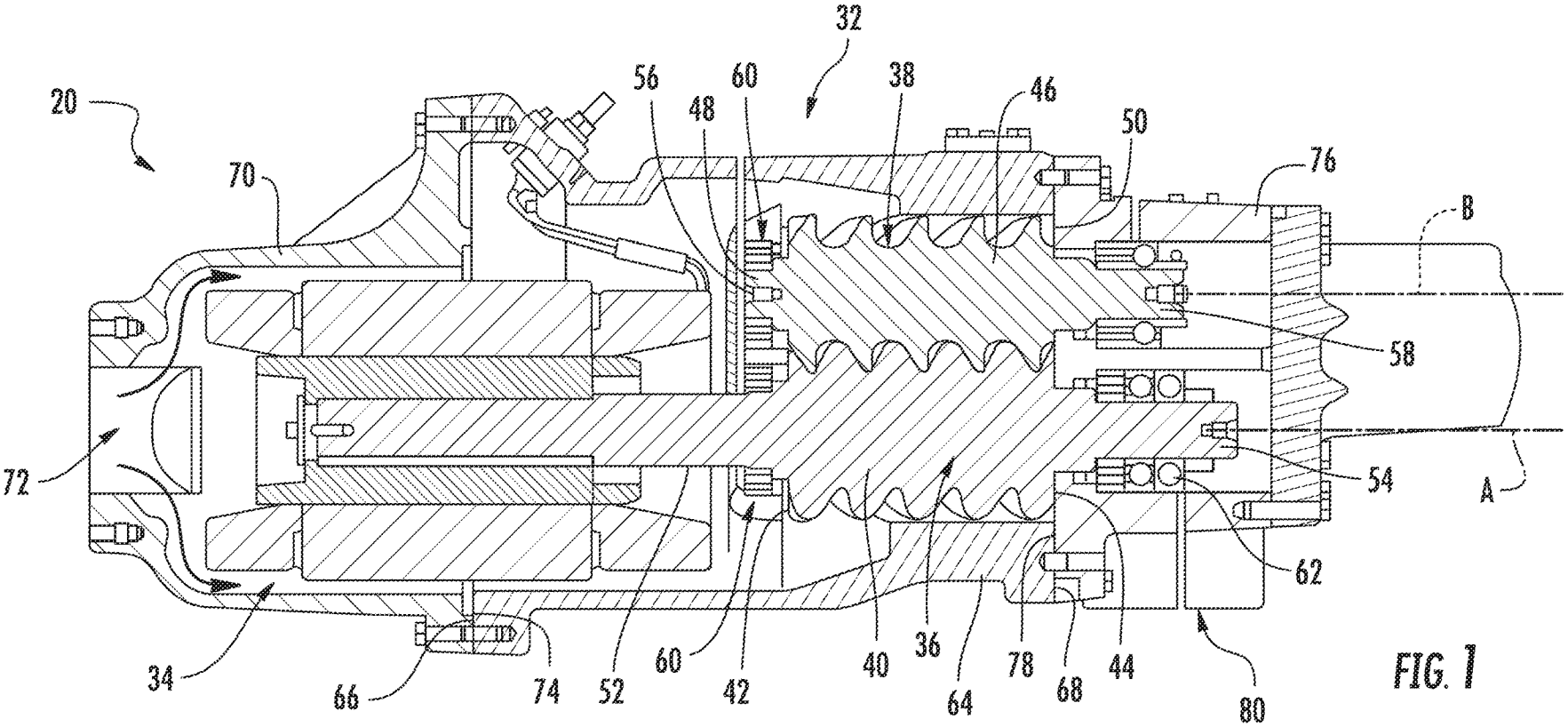
FIG. 1 is a cross-sectional view of a compressor.

Referring to FIG. 1, an example of a screw compressor 20, commonly used in air conditioning systems, is illustrated in more detail. The screw compressor 20 includes a housing assembly 32 containing a motor 34 and two or more intermeshing screw rotors 36, 38 having respective central longitudinal axes A and B. In the illustrated embodiment, the rotor 36 has a male lobed body 40 extending between a first end 42 and a second end 44. The male lobed body 40 is enmeshed with a female lobed body 46 of the other rotor 38. The female lobed body 46 of the rotor 38 has a first end 48 and a second end 50. Each rotor 36, 38 includes shaft portions 52, 54, 56, 58 extending from the first and second ends 42, 44, 48, 50 of the associated male lobed body 40, and female lobed body 46. The shaft portions 52 and 56 are mounted to the housing 32 by one or more inlet bearings 60, and the shaft portions 54, 58 are mounted to the housing 32 by one or more outlet bearings 62 for rotation about the associated rotor axis A, B.

In the illustrated embodiment, the motor 34 and the shaft portion 52 of the rotor 36 may be coupled so that the motor 34 drives the rotor 36 about axis A. When so driven in an operative first direction, the rotor 36 drives the other rotor 38 in an opposite second direction. The housing assembly 32 includes a rotor housing 64 having an upstream/inlet end face 66 and a downstream/discharge end face 68 essentially coplanar with the rotor second ends 44, 50. Although a particular compressor type and configuration is illustrated and described herein, other compressors, such as having three rotors, for example, are within the scope of the invention.

The housing assembly 32 further comprises a motor/inlet housing 70 having a compressor inlet/suction port 72 at an upstream end and having a downstream face 74 mounted to the rotor housing upstream face 66 (e.g., by bolts through both housing pieces). The assembly 32 further includes an outlet/discharge housing 76 having an upstream face 78 mounted to the rotor housing downstream face 68 and having an outlet/discharge port 80. The rotor housing 64, the motor/inlet housing 70, and outlet housing 76 may each be formed as castings subject to further finish machining. The refrigerant vapor enters into the inlet or suction port 72 with a suction pressure and exits the discharge port 80 of the compressor 20 with a discharge pressure. The refrigerant vapor within the compression mechanism of the two or more rotors 36, 38, between the inlet port 72 and the discharge port 80 has an intermediate pressure.

Figure 2:
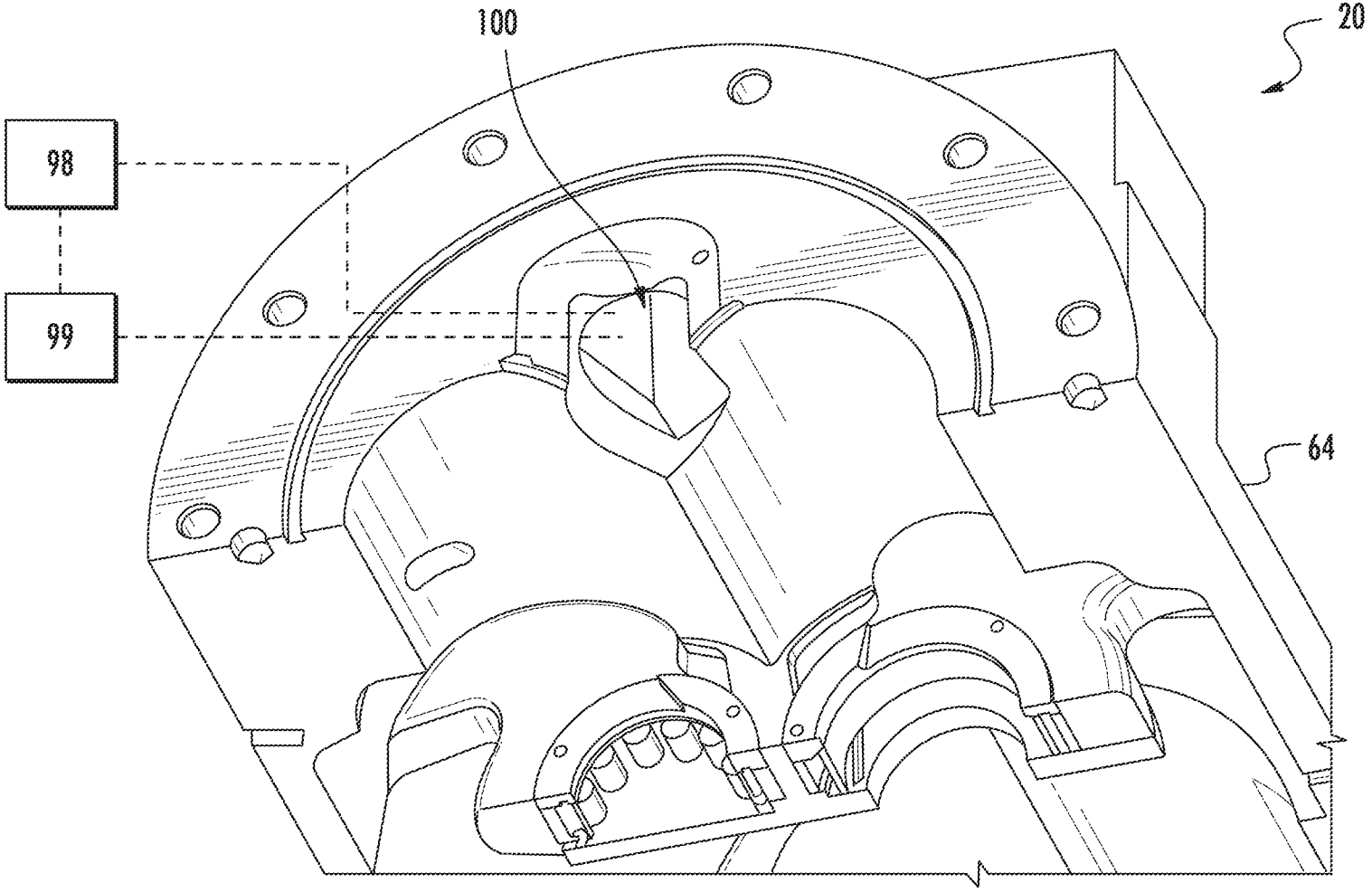
FIG. 2 is a perspective view of a volume index valve of the screw compressor.

Referring now to FIG. 2, with continued reference to FIG. 1, a volume index valve 100 is positioned within the rotor housing 64, adjacent to the discharge end 44, 50 of the rotors 36, 38. The volume index valve provides a flow path for vapor from an intermediate point of the rotors 36, 38 to the discharge port 80, bypassing the last portion of the compression. The valve 100 moves automatically between a closed position and an open position in response to the operating pressure of the refrigerant vapor within the compressor 20 to control the bypass flow and thus the volume index of the compressor 20. The valve 100 is controlled by an actuator. In some embodiments, the actuator is a solenoid actuator. Proper operation of the volume index valve 100 enables increased efficiency of the compressor 20 by actively controlling the fluid flow therethrough. This is particularly beneficial when the compressor is operated at part load, for example.

Figure 3:
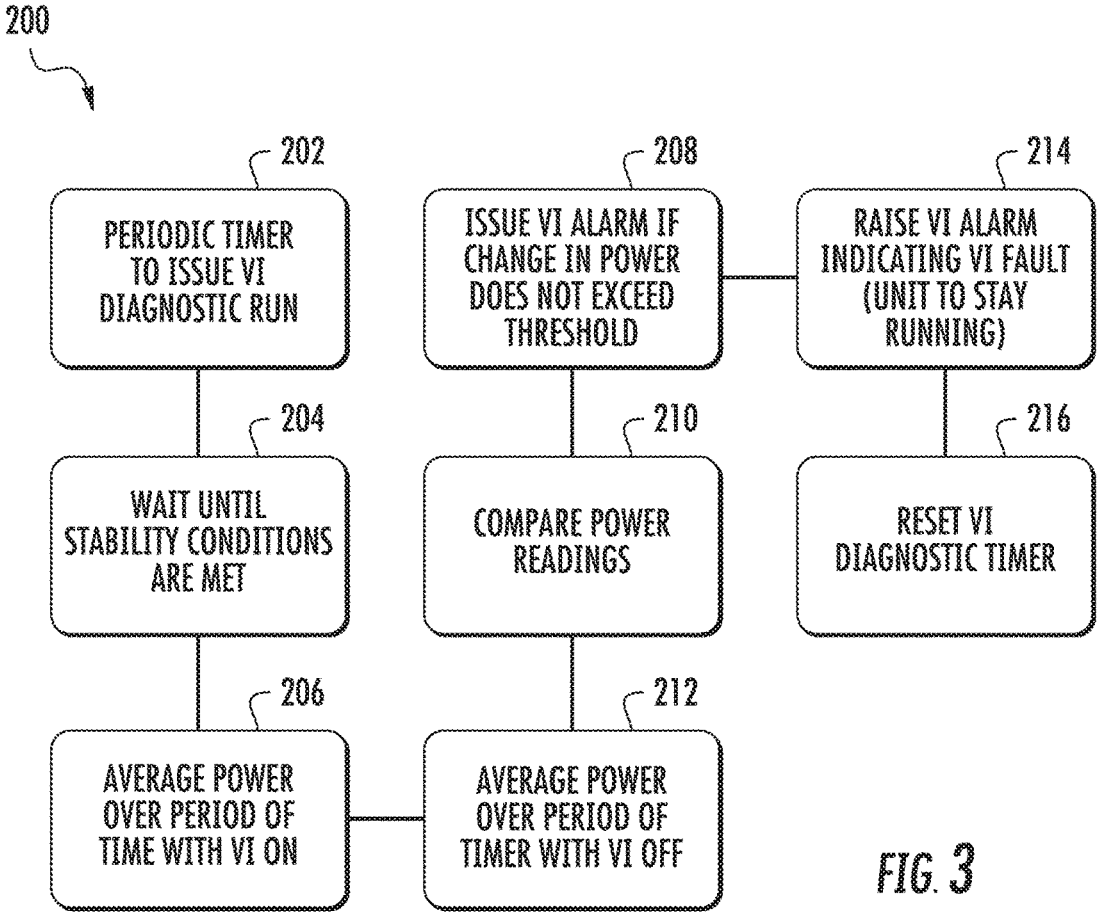
FIG. 3 is a flow diagram illustrating a method of monitoring the volume index valve.

Referring now to FIG. 3, a flow diagram illustrates a method 200 and system of monitoring operation of the volume index valve in the form of a diagnostic routine. Failure to ensure that the volume index valve 20 is opening and closing properly results in compressor operation at an efficiency that is lower than otherwise available with proper valve operation. The method and system advantageously provide verification that the volume index valve is opening and closing in a desired manner.

The method 200 may be initiated manually by an operator in some embodiments. However, in the illustrated embodiment, automatic initiation 202 of the method is provided and based on a periodic timer to cause the method to be performed at a specified time interval. Upon initiation, the method includes waiting for normal and stable operation conditions of the compressor to be met 204 and/or stable operation conditions of the system that the compressor operates within. This may include ensuring that one or more operating modes are present and that stability has been satisfied for a specified period of time. For example, compressor temperature and/or pressure within a specified range over a minimum time period may be required to perform the method. Regarding stable operating conditions of the system that the compressor operates within, an example of a system that the compressor operates within is an air conditioning application. In such embodiments, a refrigerant flow rate, system pressure, system temperature, and system efficiency are examples of operating conditions that may be required to be within a specified range to perform the method. If the stability conditions are not met, the method is aborted.

Subsequent to the conditions for stability being met, detection and recordation of an operating condition of the compressor is made 206 with the volume index valve in a first state that corresponds to a first position. In some embodiments, a plurality of recordings are made over a given time interval with the volume index valve in the first position, with the recordings averaged to provide a single operating condition reading, referred to herein as a first reading. Alternatively, or in combination with averaging the recordings, the first reading may be determined by analysis, trending, filtering, etc. The preceding list is merely illustrative and is not intended to be limiting of analysis techniques that may be employed to determine the first reading. In some embodiments, the first state of the volume index valve corresponds to an energized (i.e., ON) state that provides a closed position of the volume index valve. Once sufficient data is recorded with the volume index valve in the first state (i.e., first position), the volume index valve is switched with a controller 99 (FIG. 2) that is in operative communication with the volume index valve to a second state that corresponds to a second position. As with the first position, one or more readings are detected and recorded 208 with the volume index valve in the second position. In embodiments where a plurality of recordings is made, the recordings are averaged to provide a single compressor operating condition reading, referred to herein as a second reading. In some embodiments, the second state of the volume index valve corresponds to a non-energized (i.e., OFF) state that provides an open position of the volume index valve. Although the method is described being carried out by switching the volume index valve from the first (i.e., closed) position to the second (i.e., open) position, it is to be appreciated that the reverse may be true in some embodiments.

The operating condition of the compressor described above refers to a power reading in some embodiments. In particular, a variable frequency drive power reading of the compressor is taken at the two above-described states/positions of the volume index valve. In other embodiments, the operating current of the compressor may be utilized as the operating condition readings. The readings are obtained with a processor 98 that is in operative communication with the volume index valve 20 and the compressor 20 generally (FIG. 2). The processor 98 may be part of the controller 99 or a separate module. Although a variable speed compressor is noted above, it is to be appreciated that a fixed speed compressor benefits from the embodiments described herein.

Figure 4:
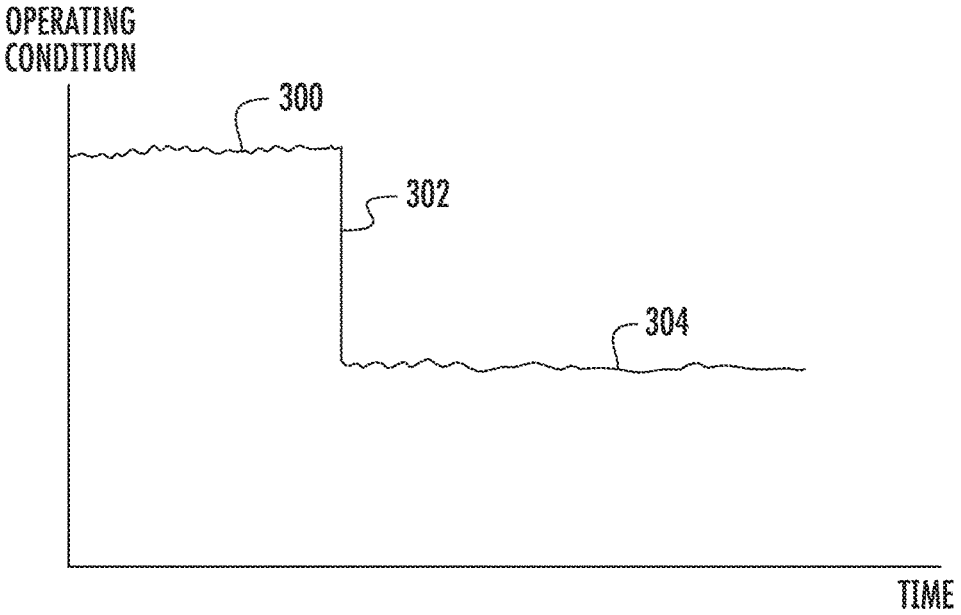
FIG. 4 is a plot of an operating condition of the compressor at various positions of the volume index valve against time.

The first and second readings are processed by the processor 98 and a difference between the two readings is calculated. As shown in FIG. 4, when the volume index valve is in the first state/position, a first operating condition reading 300 is detected. A step-like falloff of the operating condition is observed in certain areas of the compressor map when the volume index valve is switched to the second state/position, as represented with numeral 302. In particular, there are overlapping areas or "dead zones" in the operating envelope where running with or without the volume index valve does not result in much difference. The compressor could be either a fixed or variable speed compressor. Due to the availability of power reading in the variable frequency drive, that can be used to perform the volume index valve operational determination. Otherwise, the current reading may be employed for the determination for both variable and fixed speed compressors.

In the second state/position, a second operating condition reading 304 is detected. The method includes utilizing the processor 98 to determine the difference between the operating condition readings and to compare that difference to a predetermined threshold stored in memory of the processor 210. A correctly operating system will produce a measurable difference that exceeds the predetermined threshold. As described above, the operating condition measured is power in some embodiments. If the measured power difference fails to exceed the predetermined threshold, this is indicative of a hardware problem with the volume index valve itself and that it is not opening and closing properly. In the case of current as the measured operating condition, a failure to exceed the predetermined threshold is indicative of an electrical failure of the volume index valve. Additionally, installation or mechanical failure may lead to a failure to exceed the predetermined threshold.

If the predetermined threshold is not exceeded, the method includes initiating an alert 212 that prompts an operator to take a corrective action. As described above, a failure of the volume index valve impacts efficiency, but does not warrant a complete shutdown of the compressor so the system continues to operate while the alert is on 214. The alert is maintained until it is manually reset, thereby ensuring that an operator has addressed the problem. Once manually reset, a timer may be reset 216 to determine when the diagnostic routine is again initiated.

Advantageously, the method and system described herein provides a form of failure detection of the volume index valve. The volume index valve is primarily responsible for providing efficiency benefits. Therefore, a failed valve would reduce unit efficiency. Without the method and system described herein, a volume index valve failure could go unnoticed and impair operating efficiency.

The use of the terms "a" and "an" and "the" and similar referents in the context of the present disclosure (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

While the disclosure has been described in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that aspects of the disclosure may include only some of the described embodiments. Accordingly, the disclosure is not to be seen as limited by the foregoing description, but is only limited by the scope of the appended claims.

What is claimed is:

1. A method of monitoring a volume index valve of a compressor comprising:

recording a first reading of an operating condition of the compressor when the volume index valve is in a first position;

switching the volume index valve to a second position;

recording a second reading of the operating condition of the compressor when the volume index valve is in the second position;

calculating a difference between the first reading and the second reading; and comparing the difference to a predetermined threshold difference and determining that the volume index valve is not moving between the first position and the second position in a predetermined manner when the difference does not exceed the predetermined threshold.

2. The method of claim 1, further comprising:

recording a first plurality of readings of the operating condition when the volume index valve is in the first position;

averaging the first plurality of readings;

recording a second plurality of readings of the operating condition when the volume index valve is in the second position; and averaging the second plurality of readings, wherein the difference calculated is a difference between the averaged first and second plurality of readings.

3. The method of claim 1, further comprising initiating an alert if the difference does not exceed the predetermined threshold.

4. The method of claim 3, further comprising maintaining the alert until the alert is manually reset.

5. The method of claim 3, wherein the compressor continues to operate when the alert is initiated.

6. The method of claim 1, wherein the operating condition is a variable frequency drive power of the compressor.

7. The method of claim 1, wherein the operating condition is a measured current of the compressor.

8. The method of claim 1, further comprising automatically performing the method at a specified time interval.

9. The method of claim 1, wherein the first position of the volume index valve is an open position and the second position of the volume index valve is a closed position.

10. The method of claim 1, wherein the first position of the volume index valve is a closed position and the second position of the volume index valve is an open position.

11. The method of claim 1, wherein the method is performed under stable operating conditions of a system that the compressor operates within.

12. A volume index valve diagnostic system for detecting failure of the volume index valve, comprising:

a compressor;

a volume index valve disposed in the compressor, the volume index valve moveable between an open position and a closed position;

a controller in operative communication with the volume index valve to control whether the volume index valve is in the open position or the closed position; and a processing device for receiving data for an operating condition of the compressor when the volume index valve is in the open position and when the volume index valve is in the closed position, the processing device having stored in memory a predetermined threshold of a difference between the operating condition at the open position and the closed position;

wherein the processing device is configured to determine a difference between the operating condition at the open position and the closed position, compare the difference to the predetermined threshold, and determine that the volume index valve is not moving between the open position and the closed position in a desired manner when the difference does not exceed the predetermined threshold.

13. The system of claim 12, wherein the operating condition is a variable frequency drive power of the compressor.

14. The system of claim 12, wherein the operating condition is a measured current of the compressor.

15. The system of claim 12, wherein the processing device is programmed to:

initiate an alert if the difference is less than the predetermined threshold.

* * * * *